US009162281B2

(12) United States Patent
Nakaoka et al.

(10) Patent No.: US 9,162,281 B2
(45) Date of Patent: Oct. 20, 2015

(54) CONTINUOUS CASTING METHOD AND CONTINUOUS CASTING DEVICE FOR TITANIUM INGOTS AND TITANIUM ALLOY INGOTS

(71) Applicant: Kobe Steel, Ltd., Hyogo (JP)

(72) Inventors: Takehiro Nakaoka, Hyogo (JP); Kazuyuki Tsutsumi, Hyogo (JP); Eisuke Kurosawa, Hyogo (JP); Hideto Oyama, Hyogo (JP); Hidetaka Kanahashi, Hyogo (JP); Hitoshi Ishida, Hyogo (JP); Daiki Takahashi, Hyogo (JP); Daisuke Matsuwaka, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 14/372,598

(22) PCT Filed: Mar. 6, 2013

(86) PCT No.: PCT/JP2013/056165
§ 371 (c)(1),
(2) Date: Jul. 16, 2014

(87) PCT Pub. No.: WO2013/133332
PCT Pub. Date: Sep. 12, 2013

(65) Prior Publication Data

US 2014/0360694 A1 Dec. 11, 2014

(30) Foreign Application Priority Data

Mar. 6, 2012 (JP) ..... 2012-049517

(51) Int. Cl.
*B22D 11/00* (2006.01)
*B22D 11/041* (2006.01)
*B22D 11/103* (2006.01)

(Continued)

(52) U.S. Cl.
CPC ..... *B22D 11/008* (2013.01); *B22D 11/001* (2013.01); *B22D 11/041* (2013.01);
(Continued)

(58) Field of Classification Search
CPC .. B22D 11/001; B22D 11/041; B22D 11/103; B22D 41/015
USPC ..... 164/266, 335, 337, 469, 470, 494, 495, 164/506, 508, 509; 266/200, 275; 222/591–607
See application file for complete search history.

(56) References Cited

U.S. PATENT DOCUMENTS 6,019,812 A * 2/2000 Volas et al. ..... 75/10.19
6,904,955 B2 * 6/2005 Jackson et al. ..... 164/514
2006/0230876 A1 10/2006 Blum et al.

FOREIGN PATENT DOCUMENTS

JP 2005-508758 A 4/2005
JP 2009-161855 A 7/2009
JP 2009-299098 A 12/2009

OTHER PUBLICATIONS

International Search Report; PCT/JP2013/056165; Jun. 11, 2013.
(Continued)

*Primary Examiner* — Kevin E Yoon
(74) *Attorney, Agent, or Firm* — Studebaker & Brackett PC

(57) ABSTRACT

The continuous casting device according to the present invention enables at least some of a plurality of hearths (3) to be converted between being hearths (13) used for titanium, which are used during the continuous casting of titanium ingots, and being hearths (23) used for titanium alloy, which are used during the continuous casting of titanium alloy ingots. The number of hearths (23) used for titanium alloy is greater than the number of hearths (13) used for titanium. Also, the total capacity of the hearths (23) used for titanium alloy is greater than the total capacity of the hearths (13) used for titanium. Thus, titanium ingots and titanium alloy ingots can each be continuously cast by means of a single piece of equipment.

13 Claims, 6 Drawing Sheets

(51) Int. Cl.
*B22D 41/015* (2006.01)
*F27D 11/08* (2006.01)
*F27D 99/00* (2010.01)

(52) U.S. Cl.
CPC ..... *B22D11/103* (2013.01); *B22D 41/015* (2013.01); *F27D 11/08* (2013.01); *F27D 2099/0031* (2013.01)

(56) References Cited

OTHER PUBLICATIONS

Written Opinion of the International Searching Authority; PCT/JP2013/056165; Jun. 11, 2013.

* cited by examiner (a)

(b)

CONTINUOUS CASTING METHOD AND CONTINUOUS CASTING DEVICE FOR TITANIUM INGOTS AND TITANIUM ALLOY INGOTS

TECHNICAL FIELD

The present invention relates to a continuous casting device and a continuous casting method for titanium ingots and titanium alloy ingots capable of respectively producing titanium ingots and titanium alloy ingots by continuous casting.

BACKGROUND ART

Continuous casting for producing ingots made of titanium or a titanium alloy has conventionally been performed by injecting titanium or a titanium alloy melted by plasma arc melting into a bottomless mold and while solidifying it, withdrawing the resulting ingot downward. As disclosed in Patent Document 1, a molten metal obtained by melting titanium or a titanium alloy is temporarily retained in a retainer called "hearth" and the molten metal is injected into the mold from this hearth.

The hearth is usually a container made of copper and equipped, inside or outside thereof, with a forced cooling mechanism such as water cooing hole in order to prevent titanium from being contaminated. In addition, in order to prevent the molten metal from solidifying in the hearth, the surface of the molten metal in the hearth is heated. The purpose of providing such a hearth is to make the molten metal temperature uniform, prevent the raw material which has remained without being melted from entering the mold, precipitate inclusions and separate them from the molten metal, and reduce variation in the injection amount of the molten metal into the mold due to variation in a melted amount of the raw material.

PRIOR ART DOCUMENT

Patent Document

[Patent Document 1] Japanese Patent Laid-Open No. 2009-299098

SUMMARY OF INVENTION

Technical Problem

When the hearth has a too large capacity or the number of the hearths is too large, however, the molten metal solidifies at the end portion of the hearth or at a channel provided between hearths. In addition to this problem, an increase in the amount of titanium which has remained in the hearth or an increase in heat loss due to heat dissipation from the hearth leads to a cost increase. A hearth suitable for raw materials or the purpose of use should therefore be employed.

When titanium ingots are produced by continuous casting, an amount of inclusions is small so that increasing the capacity of a hearth and thereby prolonging the retention time of a molten metal for the purpose of precipitating the inclusions is not necessary. Rather in this case, it is desired to decrease the capacity of the hearth to suppress heat dissipation from the hearth and reduce an electric power consumption rate by plasma arc for heating the surface of the molten metal. On the other hand, when titanium alloy ingots are produced by continuous casting, an amount of inclusions is large so that increasing the capacity of a hearth and thereby securing a sufficient retention time of a molten metal for the purpose of precipitating the inclusions is required. The term "electric power consumption rate" is an electric energy necessary per unit production amount of a product and it is an objective indicator of production efficiency.

As described above, there is a difference in the suitable shape of a hearth between continuous casting for titanium ingots and continuous casting for titanium alloy ingots. It has therefore been conventionally difficult to produce titanium ingots and titanium alloy ingots respectively in a single facility by continuous casting.

An object of the present invention is to provide a continuous casting device and a continuous casting method for titanium ingots and titanium alloy ingots capable of continuously casting and thereby producing titanium ingots and titanium alloy ingots respectively in a single facility.

Solution to Problem

In the present invention, there is provided a continuous casting device for titanium ingot and titanium alloy ingot which injects a molten metal having titanium or a titanium alloy melted therein into a bottomless mold via a plurality of hearths and while solidifying the molten metal, withdraws the resulting ingot downward, and thereby produces an ingot made of the titanium or titanium alloy by continuous casting. This device is characterized in that as at least some of the hearths, hearths for titanium to be used at the time of continuous casting for titanium ingot and hearths for titanium alloy to be used at the time of continuous casting for titanium alloy ingot can be used exchangeably. The latter hearths are greater in number and also greater in total capacity than the former hearths.

In the present invention, there is also provided a continuous casting method for titanium ingot and titanium alloy ingot including injecting a molten metal having titanium or a titanium alloy melted therein into a bottomless mold via a plurality of hearths and while solidifying the molten metal, withdrawing the resulting ingot downward. This method is characterized in that as at least some of the hearths, hearths for titanium to be used at the time of continuous casting for titanium ingot and hearths for titanium alloy to be used at the time of continuous casting for titanium alloy ingot can be used exchangeably; the latter hearths are greater in number and also in total capacity than the hearths for titanium; and the hearths for titanium alloy are exchanged with the hearths for titanium at the time of continuous casting for titanium ingot, while the hearths for titanium are exchanged with the hearths for titanium alloy at the time of continuous casting for titanium alloy ingot.

Advantageous Effects of Invention

The continuous casting device and continuous casting method for titanium ingots and titanium alloy ingots according to the present invention make it possible to produce titanium ingots and titanium alloy ingots respectively in a single facility by continuous casting.

BRIEF DESCRIPTION OF DRAWINGS

FIG. 1 is a view showing production of titanium ingots by continuous casting using a continuous casting device according to First Embodiment, in which (*a*) is a top view and (*b*) is an A-A cross-sectional view of (*a*).

FIG. 2 is a view showing production of titanium alloy ingots by continuous casting using the continuous casting device according to First Embodiment, in which (*a*) is a top view and (*b*) is an B-B cross-sectional view of (*a*).

FIG. 3 is a view showing the relation between a plasma torch and a hearth (α) when titanium ingots are produced by continuous casting and (β) when titanium alloy ingots are produced by continuous casting, each by using the continuous casting device according to First Embodiment.

FIG. 4 is a view showing the relation between a plasma torch and a hearth (α) when titanium ingots are produced by continuous casting and (β) when titanium alloy ingots are produced by continuous casting, each by using a continuous casting device according to Second Embodiment.

FIG. 6 is a top view showing continuous production of titanium ingots by continuous casting using a continuous casting device according to a modification example of Third Embodiment.

DESCRIPTION OF EMBODIMENTS

Preferred embodiments of the present invention will hereinafter be described referring to drawings.

[First Embodiment]

(Constitution of Continuous Casting Device)

Figure 1:
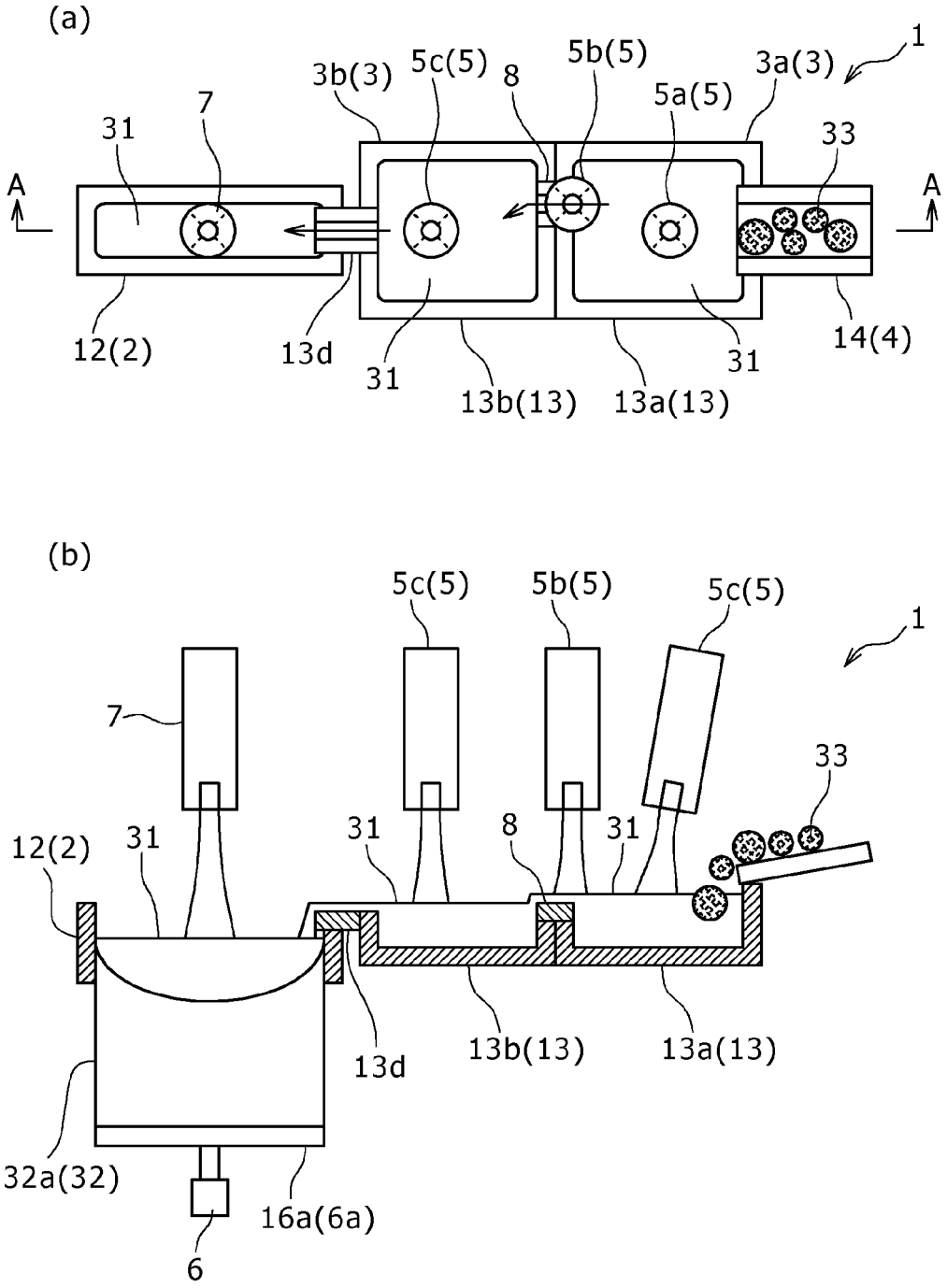
[FIG. 1]
Figure 2:
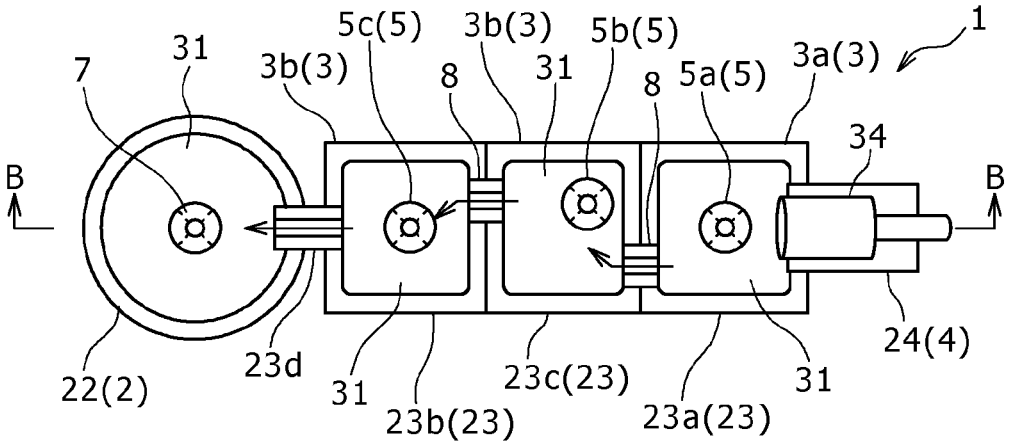
[FIG. 2]
Figure 2:
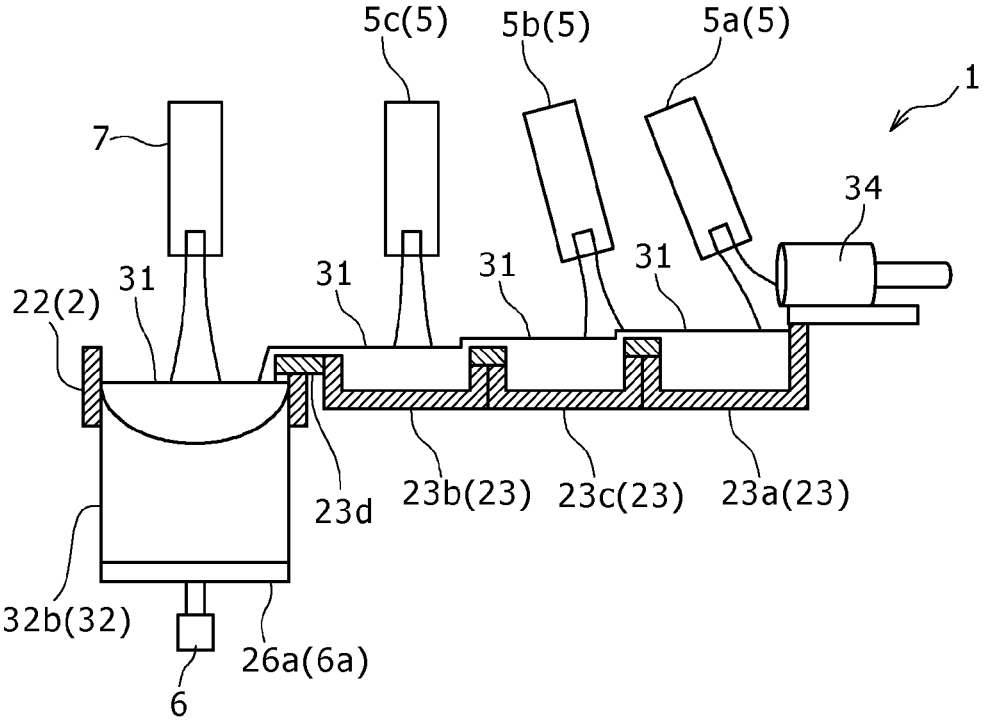

A continuous casting device 1 for titanium ingots and titanium alloy ingots (continuous casting device) 1 according to First Embodiment of the present invention has, as shown in FIGS. 1(*a*) and (*b*) and FIGS. 2(*a*) and (*b*), which are top views, a mold 2, a plurality of hearths 3, a raw material feeder 4, a plurality of plasma torches (plasma arc heaters) 5, a withdrawing unit 6, and a plasma torch 7. The continuous casting device 1 is placed in a chamber not illustrated in the drawing and the chamber has an inert gas atmosphere made of an argon gas, helium gas, or the like.

The mold 2 is equipped, inside or outside thereof, with a forced cooling mechanism such as water cooling hole and at the same time, it is a bottomless container made of copper. A molten metal 31 obtained by melting titanium (pure titanium) or a titanium alloy is injected into this container. The molten metal 31 injected into the mold 2 is solidified by cooling into an ingot 32. The mold 2 is constituted so as to be exchangeable in accordance with the shape of an ingot 32 to be produced by casting. FIG. 1(*a*) shows a mold 12 having a rectangular cross-sectional shape to be used in continuous casting for a plate-like slab 32*a*. FIG. 2(*a*) shows a mold 22 having a circular cross-sectional shape to be used in continuous casting for a columnar ingot 32*b*. Due to the relation with a withdrawing unit 6 which will be described later, the mold 2 is exchangeable with another mold having any cross-sectional shape so that they have the same gravity center position.

Since the mold 12 and the mold 22 have the same gravity center position, the peripheries of these molds 2 can be monitored in the same direction from the outside of the chamber. This facilitates monitoring of working conditions.

The plurality of hearths 3 inject the molten metal 31 into the mold 2. The hearths 3 have a raw material introduction hearth 3*a* into which a raw material of the ingot 32 is introduced and a molten metal transfer hearth 3*b* placed on the downstream side of the raw material introduction hearth 3*a*. Two hearths 3 adjacent to each other are linked by a channel 8. In the present embodiment, all the hearths 3 are exchangeable in accordance with the raw material of the ingot 32. FIGS. 1(*a*) and (*b*) show hearths 13 for titanium comprised of the plurality of hearths 3 and used when a slab (titanium ingot) 32*a* which is an ingot made of titanium is produced by continuous casting. FIGS. 2(*a*) and (*b*), on the other hand, show hearths 23 for titanium alloy comprised of the plurality of hearths 3 and used when an ingot (titanium alloy ingot) 32*b* made of a titanium alloy is produced by continuous casting.

As shown in FIGS. 1(*a*) and (*b*), the hearths 13 for titanium have a raw material introduction hearth 13*a* and a molten metal injection hearth 13*b*. Into the raw material introduction hearth 13*a*, sponge titanium 33, a raw material of the slab 32*a*, is introduced from a raw material introduction unit 14 which will be described later. The molten metal injection hearth 13*b* is equipped with a molten metal injection unit 13*d* for injecting the molten metal 31 into the mold 12.

By injecting the molten metal 31 into the mold 12 from the short side of the mold 12 having a rectangular cross-sectional shape, the high-temperature molten metal 31 is allowed to flow from the end portion, which has a greater contact area with the mold 12 and having a higher cooling rate than the center portion in the long side direction of the mold 12, toward the center portion. By injecting the high-temperature molten metal 31 into the end portion having a higher cooling rate and allowing it to flow toward the center portion having a lower cooling rate, the cooled state (temperature) of the molten metal 31 at the end portion of the mold 12 and the cooled state (temperature) of the molten metal 31 at the center portion of the mold 12 can be made uniform.

As shown in FIGS. 2(*a*) and (*b*), on the other hand, hearths 23 for titanium alloy have a raw material introduction hearth 23*a*, a molten metal injection hearth 23*b*, and a flow control hearth 23*c*. The raw material introduction hearth 23*a* is injected with titanium droplets obtained by melting a rod-like ingot 34 made of a titanium alloy by means of a plasma torch 5 which will be described later. The molten metal injection hearth 23*b* is provided with a molten metal injection unit 23*d* for injecting the molten metal 31 into a mold 22. The flow control hearth 23*c* is, as shown in FIG. 2(*a*), linked to the raw material introduction hearth 23*a* by a channel 8 provided on the lower side of the drawing and at the same time, linked to the molten metal injection hearth 23*b* by a channel 8 provided on the upper side of the drawing. Since they are linked to each other in such a manner, the molten metal 31 which has entered the flow control hearth 23*c* diagonally crosses the flow control hearth 23*c* and is discharged from the flow control hearth 23*c*. This makes it possible to prolong the retention time of the molten metal 31 in the flow control hearth 23*c*.

Continuous casting for the slab 32*a* made of titanium can be carried out without generating a large amount of inclusions such as HDI (high-density inclusions) and LDI (low-density inclusions). It is therefore not necessary to increase the capacity of the hearth 13 for titanium and thereby prolong the retention time of the molten metal 31 for the purpose of precipitating inclusions therein. Rather, decreasing the capacity of the hearth 13 for titanium and thereby suppressing heat dissipation from the hearth 3 is preferred. On the other hand, continuous casting for the ingot 32*b* made of a titanium alloy is carried out while generating a large amount of inclusions. It is therefore necessary to increase the capacity of the hearth 23 for titanium alloy and thereby secure an adequate retention time of the molten metal 31 for the purpose of precipitating inclusions in the hearth. Therefore, the hearths 13 for titanium have two hearths 3, that is, the raw material introduction hearth 13*a* and the molten metal injection hearth 13*b*, while the hearths 23 for titanium alloy have three hearths 3, that is, the raw material introduction hearth 23*a*, the molten metal injection hearth 23*b*, and the flow control hearth 23*c*. The number of the hearths 23 for titanium alloy is greater than that of the hearths 13 for titanium. Not only the number of the hearths 23 for titanium alloy is greater but also the total capacity of them is greater than that of the hearths 13 for titanium.

Thus, at the time of continuous casting for the slab 13, the hearths 13 for titanium smaller in number and total capacity than the hearths 23 for titanium alloy are used. This makes it possible to preferably carry out continuous casting for the slab 32*a* while suppressing heat dissipation from the hearths 3. At the time of continuous casting for the ingot 32*b*, on the other hand, the hearths 23 for titanium alloy greater in number and total capacity than the hearths 13 for titanium are used. This makes it possible to preferably carry out continuous casting for the ingot 32*b* while securing a retention time enough for precipitating inclusions. It is to be noted that even in continuous casting for ingots made of a titanium alloy, the hearths 13 for titanium may be used when an intended quality level is not so high or the amount of inclusions is not large because a raw material to be melted has good quality.

The raw material introduction hearth 13*a* and the molten metal injection hearth 13*b* may be integrated with each other or may be separated from each other. Similarly, the raw material introduction hearth 23*a*, the molten metal injection hearth 23*b*, and the flow control hearth 23*c* may be integrated with one another or may be separated from one another.

A raw material introduction unit 4 introduces a raw material into the raw material introduction hearth 3*a*. The raw material introduction unit 4 is constituted to be exchangeable in accordance with the raw material to be used. FIG. 1(*a*) shows a raw material introduction unit 14 which introduces sponge titanium 33 to be used in continuous casting for the slab 32*a* made of titanium. The raw material of the ingot made of titanium is not limited to the sponge titanium 33 and it may be titanium scraps or the like. FIG. 2(*a*) shows, on the other hand, a raw material introduction unit 24 which advances the rod-like ingot 34 made of a titanium alloy to be used in continuous casting for the ingot 32*b* made of a titanium alloy.

The raw material introduction unit 14 and the raw material introduction unit 24 introduce the raw material in the same direction so that the monitoring directions of the raw material introduction from the outside of the chamber can be made equal. This facilitates monitoring of the working condition.

A plurality of plasma torches 5 penetrating through the chamber are provided so as to be placed above the plurality of hearths 3. They heat the raw material which has been introduced into the hearths 3 and the surface of the molten metal 31 in the hearths 3 by means of plasma arc. In the present embodiment, three plasma torches 5 are provided with a predetermined interval so as to avoid mutual interference. The number of the plasma torches 5 is not limited to three. The plasma torches 5 are swingable with a support 5*d* (refer to FIG. 3), which will be described later, as a center. They may also be movable vertically, but their moving range is limited due to the structure that they penetrate through the chamber.

As shown in FIGS. 1(*a*) and (*b*), with regard to the operation of the plasma torches for the hearths 13 for titanium, the plasma torch 5*a* on the uppermost stream side is operated to heat the raw material and the surface of the molten metal 31 in the raw material introduction hearth 13*a*; the plasma torch 5*c* on the downmost stream side is operated to heat the surface of the molten metal 31 in the molten metal injection hearth 13*b*; and the plasma torch 5*b* at the center is operated to heat the surface of the molten metal 31 in the channel 8. Heating the surface of the molten metal 31 in the channel 8 by using the plasma torch 5*b* prevents the molten metal 31 from solidifying in the channel 8.

As shown in FIGS. 2(*a*) and (*b*), with regard to the operation of the plasma torches for the hearths 23 for titanium alloy, on the other hand, the plasma torch 5*a* on the uppermost stream side is operated to heat the ingot 34 to be advanced by the raw material introduction unit 24 and the surface of the molten metal 31 in the raw material introduction hearth 23*a*; the plasma torch 5*c* on the downmost stream side is operated to heat the surface of the molten metal 31 in the molten metal injection hearth 23*b*; and the plasma torch 5*b* at the center is operated to heat the surface of the molten metal 31 in the flow control hearth 23*c*.

Figure 3:
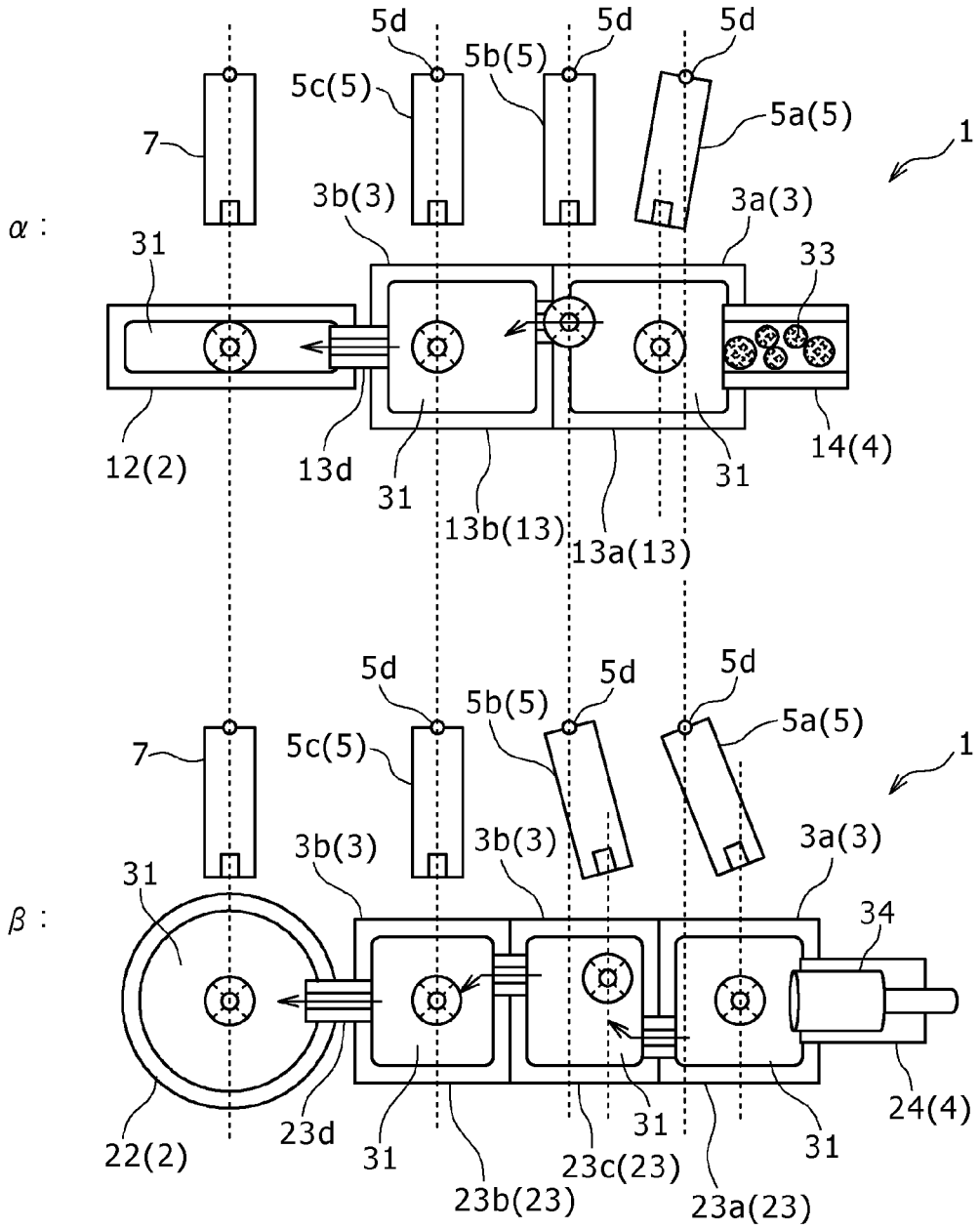
[FIG. 3]

As described above, due to the structure that the plasma torches 5 each penetrate through the chamber, the plasma torches 5 are each placed at a fixed position. FIG. 3 is a view showing the relation between the plasma torches 5 and a plurality of the hearths 3 in the continuous casting device 1 (α) when the slab 32*a* made of titanium is produced by continuous casting and (β) when the ingot 32*b* made of a titanium alloy is produced by continuous casting. As shown in FIG. 3, the position of each of the supports 5*d* of the three plasma torches 5 is the same between the hearths 13 for titanium and the hearths 23 for titanium alloy. By swinging each of the plasma torches 5, the surface of the molten metal 31 in the hearths 3 can be heated preferably, though the hearth 13 for titanium and the hearth 23 for titanium alloy are different in shape. Since a change in the placing position of each of the plasma torches 5 is not required, exchange between the hearth 13 for titanium and the hearth 23 for titanium alloy can be performed with improved working efficiency. In FIG. 3, the support 5*d* is placed on the upper end surface of the plasma torch 5, but the position of the support 5*d* is not limited thereto.

Referring back again to FIG. 1(*b*) and FIG. 2(*b*), the withdrawal unit 6 supports a starting block 6*a* capable of blocking the lower-side opening portion of the mold 2 from therebelow. It withdraws the ingot 32, which has been obtained by solidifying the molten metal 31 in the mold 2, downward by pulling down the starting block 6*a* at a predetermined velocity. The starting block 6*a* is constituted to be exchangeable in accordance with the shape of the mold 2. FIG. 1(*b*) shows a rectangular starting block 16*a* capable of blocking the lower-side opening portion of the mold 12 having a rectangular cross-sectional shape. FIG. 2(*b*), on the other hand, shows a circular starting block 26*a* capable of blocking the lower-side opening portion of the ingot 22 having a circular cross-sectional shape.

As described above, the mold 2 is exchangeable with a mold having any cross-sectional shape without changing the gravity center position. The withdrawal unit 6 is placed to withdraw the ingot 32 with the gravity center position of the mold 2 as a center. Since the ingot 32 is withdrawn with the gravity center position of the mold 2 as a center, transfer of the position of the withdrawal unit 6 is not necessary whatever cross-sectional shape the mold 2 has. In addition, since the ingot 32 is withdrawn with the gravity center position of the mold 2 as a center, a withdrawing power of the withdrawal unit 6 can be caused to act uniformly in the mold 2 whatever cross-sectional shape the mold 2 has. The ingot 32 can therefore be withdrawn without causing non-uniformity in withdrawal power or a withdrawal failure due to bending of the ingot 32.

The plasma torch 7 penetrates through the chamber so as to be placed above the mold 2 and it heats the surface of the molten metal 31 injected into the mold 2 by means of plasma arc. The plasma torch 7, similarly to the plasma torch 5, can be swung with a support as a center and it may also be moved in a vertical direction.

A titanium alloy is hard to be cast by electron beam melting in a vacuum atmosphere due to evaporation of minor components, but plasma arc melting in an inert gas atmosphere can cast not only titanium but also a titanium alloy.

(Behavior of Continuous Casting Device)

Next, referring to FIGS. 1(*a*) and (*b*) and FIGS. 2(*a*) and (*b*), the behavior of the continuous casting device 1 will be described. This description will be made based on the premise that the behavior of the continuous casting device 1 can be switched between continuous casting for the plate-like slab 32*a* made of titanium and continuous casting for the circular ingot 32*b* made of a titanium alloy. The ingot 32 made of titanium is however not limited to the slab 32*a* and the ingot 32 made of a titanium alloy is not limited to the circular ingot 32*b*.

First, a description will be given of continuous casting for the slab 32*a* conducted after switching from continuous casting for the ingot 32*b* made of a titanium alloy to continuous casting for the slab 32*a* made of titanium. In this case, the mold 22 having a circular cross-sectional shape is exchanged with the mold 12 having a rectangular cross-sectional shape. In addition, the starting block 26*a* capable of blocking the lower-side opening portion of the mold 22 having a circular cross-sectional shape is exchanged with the starting block 16*a* capable of blocking the lower-side opening portion of the mold 12. The starting block 16*a* is supported with the withdrawal unit 6 and the lower-side opening portion of the mold 12 is blocked with the starting block 16*a*. Further, the hearths 23 for titanium alloy are exchanged with the hearths 13 for titanium. The raw material introduction unit 24 for continuous casting for the ingot 32*b* made of a titanium alloy is exchanged with the raw material introduction unit 14 for continuous casting for the slab 32*a* made of titanium. By swinging three plasma torches 5, the direction of each of the plasma torches 5 is adjusted so that they work for the hearths 13 for titanium.

As shown in FIG. 3, by swinging each of the plasma torches 5, the surface of the molten metal 31 in the hearth 3 can be preferably heated in spite of a difference in the shape between the hearth 13 for titanium and the hearth 23 for titanium alloy. Exchange between the hearth 13 for titanium and the hearth 23 for titanium alloy therefore does not require a change in the placing position of each of the plasma torches 5 so that improvement in working efficiency can be achieved.

Then, introduction of the sponge titanium 33 from the raw material introduction unit 14 to the raw material introduction hearth 13*a* is started and at the same time, heating with the plasma torch 5 is started. The sponge titanium 33 introduced into the raw material introduction hearth 13*a* is melted by heating with the plasma torch 5*a* into a molten metal 31 and the molten metal fills the raw material introduction hearth 13*a*. The molten metal 31 overflowing from the raw material introduction hearth 13*a* passes through the channel 8, enters the molten metal injection hearth 13*b*, and gradually fills the molten metal injection hearth 13*b*. The molten metal 31 overflowing from the molten metal injection hearth 13*b* passes through the molten metal injection unit 13*d*, and injected into the mold 12. The molten metal 31 injected into the mold 12 is gradually solidified by cooling. The starting block 16*a* which has blocked the lower-side opening portion of the mold 12 is pulled down at a predetermined velocity. The slab 32*a* obtained by solidifying the molten metal 31 is withdrawn downward and in such a manner, continuous casting is performed.

At the time of continuous casting for the slab 32*a*, by using the hearths 13 for titanium while decreasing the number and the total capacity thereof compared with those of the hearths 23 for titanium alloy, continuous casting for the slab 32*a* can be conducted preferably while suppressing heat dissipation from the hearths 3.

Since the slab 32*a* is withdrawn with the gravity center position of the mold 12, which is exchangeable without changing the gravity center position, as a center, transfer of the position of the withdrawal unit 6 is not necessary whatever cross-sectional shape the mold 2 has. In addition, since the slab 32*a* is withdrawn with the gravity center position of the mold 12 as a center, a withdrawal power of the withdrawal unit 6 can be caused to act in the mold 2 uniformly whatever cross-sectional shape the mold 2 has. This makes it possible to withdraw the slab 32*a* without causing non-uniformity of a withdrawing power or a withdrawal failure due to bending of the slab 32*a*.

During continuous casting for the slab 32*a*, the plasma torch 5*a* heats the raw material and the surface of the molten metal 31 in the raw material introduction hearth 13*a*; the plasma torch 5*c* heats the surface of the molten metal 31 in the molten metal injection hearth 13*b*; and the plasma torch 5*b* heats the surface of the molten metal 31 in the channel 8. The plasma torch 7, on the other hand, heats the surface of the molten metal 31 injected into the mold 12.

Next, a description will be given of continuous casting for the ingot 32*b* made of a titanium alloy to be conducted after switching from continuous casting for the slab 32*a* made of titanium to continuous casting for the ingot 32*b* made of a titanium alloy. In this case, the mold 12 having a rectangular cross-sectional shape is exchanged with the mold 22 having a circular cross-sectional shape. The starting block 16*a* capable of blocking the lower-side opening portion of the mold 12 is exchanged with the starting block 26*a* capable of blocking the lower-side opening portion of the mold 22 having a circular cross-sectional shape. The starting block 26*a* is supported with the withdrawal unit 6 and the lower-side opening portion of the mold 22 is blocked with the starting block 26*a*. In addition, the hearth 13 for titanium is exchanged with the hearth 23 for titanium alloy. Further, the raw material introduction unit 14 for continuous casting for the slab 32*a* made of titanium is exchanged with the raw material introduction unit 24 for continuous casting for the ingot 32*b* made of a titanium alloy. Still further, by swinging three plasma torches 5, the direction of each of the plasma torches 5 is adjusted so that they work for the hearths 23 for titanium alloy.

Then, advance of the rod-like ingot 34 is started from the raw material introduction unit 24 to the raw material introduction hearth 23*a* and at the same time, heating with the plasma torch 5 is started. The ingot 34 placed in the raw material introduction hearth 23*a* is melted into titanium droplets by heating with the plasma torch 5*a*. The titanium droplets drop in the raw material introduction hearth 23*a* to be a molten metal 31 and the resulting molten metal fills the raw material introduction hearth 23*a*. The molten metal 31 overflowing from the raw material introduction hearth 23*a* passes through the channel 8, enters the flow control hearth 23*c*, and gradually fills the flow control hearth 23*c*. Further, the molten metal 31 overflowing from the flow control hearth 23*c* enters the molten metal injection hearth 23*b* and gradually fills the molten metal injection hearth 23*b*. Then, the molten metal 31 overflowing from the molten metal injection hearth 23*b* is injected into the mold 22 through the molten metal injection unit 23*d*. The molten metal 31 injected into the mold 22 is gradually solidified by cooling. By pulling down the starting block 26*a* which has blocked the lower-side opening portion of the mold 22 at a predetermined velocity, the columnar ingot 32*b* obtained by solidification of the molten metal 31 is withdrawn downward and in such a manner, continuous casting is performed.

At the time of continuous casting for the ingot 32*b*, by using the hearth 23 for titanium alloy while increasing the number and total capacity thereof compared with those of the hearth 13 for titanium, continuous casting for the ingot 32*b* can be conducted preferably while securing a retention time enough for precipitating inclusions.

Since the ingot 32*b* is withdrawn with the gravity center position of the mold 22, which is exchangeable without changing the gravity center position, as a center, transfer of the position of the withdrawal unit 6 is not required whatever cross-sectional shape the mold 2 has. In addition, since the ingot 32*b* is drawn with the gravity center portion of the mold 22 as a center, a withdrawing power of the withdrawal unit 6 can be caused to act uniformly in the mold 2 whatever sectional shape the mold 2 has. This makes it possible to withdraw the ingot 32*b* without causing non-uniformity of a withdrawing power or a withdrawal failure due to bending of the ingot 32*b*.

During continuous casting for the ingot 32*b* made of a titanium alloy, the plasma torch 5*a* heats the ingot 34 and the surface of the molten metal 31 in the raw material introduction hearth 23*a*; the plasma torch 5*c* heats the surface of the molten metal 31 in the molten metal injection hearth 23*b*; and the plasma torch 5*b* heats the surface of the molten metal 31 in the flow control hearth 23*c*. The plasma torch 7, on the other hand, heats the surface of the molten metal 31 injected into the mold 22.

(Advantages)

As described above, in the continuous casting device 1 and the continuous casting method according to the present embodiment, the hearths 13 for titanium slab 32*a* smaller in both the number and total capacity than the hearths 23 for titanium alloy are used at the time of continuous casting for the slab 32 made of titanium. This enables preferable continuous casting for the slab 32*a* while suppressing heat dissipation from the hearths 3. The hearths 23 for titanium alloy greater in both the number and total capacity than the hearths 13 for titanium are used at the time of continuous casting for the ingot 32*b* made of a titanium alloy. This enables preferable continuous casting for the ingot 32*b* while securing a retention time enough for precipitating inclusions. Thus, the slab 32*a* made of titanium and the ingot 32*b* made of a titanium alloy can be produced respectively in a single facility by continuous casting.

By swinging each of the plasma torches 5, the surface of the molten metal 31 in the hearth 3 can be preferably heated in spite of a difference in the shape between the hearth 13 for titanium and the hearth 23 for titanium alloy. Exchange between the hearth 13 for titanium and the hearth 23 for titanium alloy therefore does not require a change in the placing position of each of the plasma torches 5 so that improvement in working efficiency can be achieved.

Since the ingot 32 is withdrawn with the gravity center position of the mold 2, which is exchangeable without changing the gravity center position, as a center, transfer of the position of the withdrawal unit 6 is not required whatever cross-sectional shape the mold 2 has. In addition, since the ingot 32 is drawn with the gravity center portion of the mold 2 as a center, a withdrawing power of the withdrawal unit 6 can be caused to act uniformly in the mold 2 whatever sectional shape the mold 2 has. This makes it possible to withdraw the ingot 32 without causing non-uniformity of a withdrawing power or a withdrawal failure due to bending of the ingot 32.

[Second Embodiment]

(Constitution of Continuous Casting Device)

Figure 4:
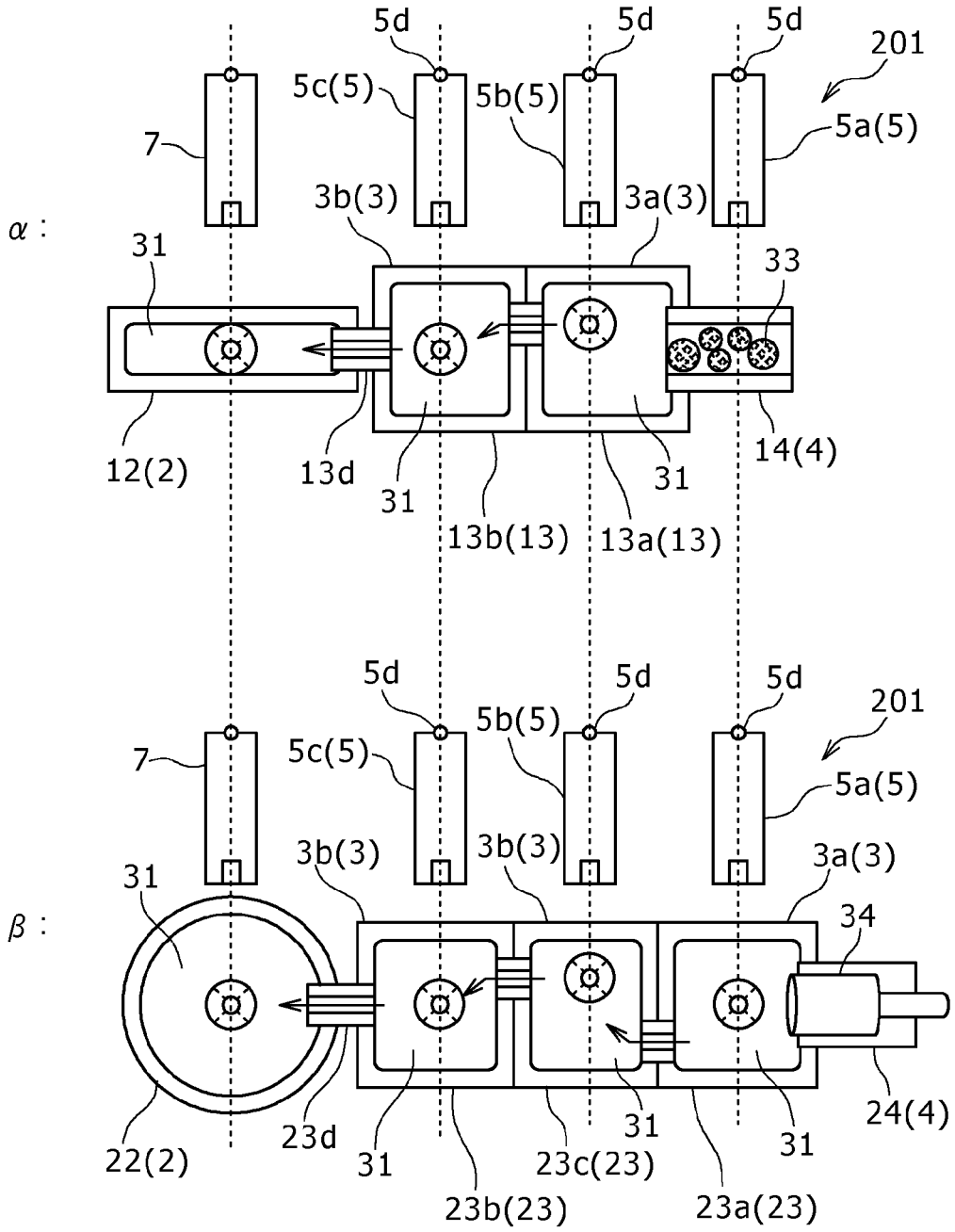
[FIG. 4]

A continuous casting device 201 according to Second Embodiment of the present invention will next be described. For constituent elements similar to the constituents element described above, the same reference numbers are attached, respectively and a description on them is omitted. FIG. 4 shows a relation in the continuous casting device 201 between the plasma torch 5 and the plurality of hearths 3 in (α) continuous casting for the slab 32*a* made of titanium and in (β) continuous casting for the ingot 32*b* made of a titanium alloy. A difference of the continuous casting device 201 of the present embodiment from the continuous casting device 1 according to First Embodiment is that as shown in FIG. 4, the plasma torch 5*a* on the uppermost stream side is not used in (α) continuous casting for the slab 32*a* made of titanium. Also in the present embodiment, the position of each of supports 5*d* of the three plasma porches 5 is the same for both the hearth 13 for titanium and the hearth 23 for titanium alloy.

At the time of continuous casting (β) for the ingot 32*b* made of a titanium alloy, as shown on the lower side of FIG. 4, the plasma torch 5*a* on the uppermost stream side is operated to heat the ingot 34 advanced by the raw material introduction unit 24 and the surface of the molten metal 31 in the raw material introduction hearth 23*a*. The plasma torch 5*c* on the downmost stream side is operated to heat the surface of the molten metal 31 in the molten metal injection hearth 23*b*. The plasma torch 5*b* at the center is operated to heat the surface of the molten metal 31 in the flow control hearth 23*c*.

At the time of continuous casting (α) for the slab 32*a* made of titanium, on the other hand, as shown on the upper side in FIG. 4, the plasma torch 5*b* at the center is operated to heat the raw material and the surface of the molten metal 31 in the raw material introduction hearth 13*a*. The plasma torch 5*c* on the downmost stream side is operated to heat the surface of the molten metal 31 in the molten metal injection hearth 13*b*. The plasma torch 5*a* on the uppermost stream side is in a suspended state.

When the slab 32*a* made of titanium is produced by continuous casting, due to a small amount of inclusions, it is not necessary to increase the capacity of the hearths 13 for titanium and thereby increase the retention time of the molten metal 31 in order to precipitate the inclusions. The number of the hearths 13 for titanium is therefore made smaller and also the total capacity of them is made smaller than those of the hearths 23 for titanium alloy. In continuous casting for the slab 32*a* made of titanium, therefore, it is desired to reduce, in accordance with the total capacity of the hearths 13 for titanium or the number of the hearths 3, an electric power consumption rate by plasma arc for heating the surface of the molten metal 31. The term "electric power consumption rate" means an amount of electric power required for a unit production amount of a product and it is an indicator objectively showing production efficiency. For the hearths 23 for titanium alloy, all of the three plasma torches 5 are used, while two of the three plasma torches 5 are used for the hearths 13 for titanium. Described specifically, the number of the plasma torches 5 used at the time of continuous casting for the ingot 32*b* made of a titanium alloy is greater than the number of the plasma torches 5 used at the time of continuous casting for the slab 32*a* made of titanium. A total output, per unit melting amount, of the plasma torches 5 to be used at the time of continuous casting for the ingot 32*b* made of a titanium alloy is greater than a total output, per unit melting amount, of the plasma torches 5 to be used at the time of continuous casting for the slab 32*a* made of titanium.

Thus, at the time of continuous casting for the slab 32*a* made of titanium, the number and the total capacity of the hearths 13 for titanium to used are both smaller than those of the hearths 23 for titanium alloy. In addition, the number of the plasma torches 5 and the total output, per unit melting amount, of the plasma torches 5 to be used are made smaller than those at the time of continuous casting for the ingot 32*b* made of a titanium alloy. This enables preferable heating of the surface of the molten metal 31 in the hearths 3 while reducing the electric power consumption rate. At the time of continuous casting for the ingot 32*b* made of a titanium alloy, on the other hand, the number and the total capacity of the hearths 23 for titanium alloy to be used are both greater than those of the hearths 13 for titanium. In addition, the number of the plasma torches 5 and the total output, per unit melting amount, of the plasma torches 5 to be used are made greater than those at the time of continuous casting for the slab 32*a* made of titanium. This enables preferable heating of the surface of the molten metal 31 in the hearths 3 while suppressing the molten metal 31 from being solidified in the hearths 3.

(Advantages)

As described above, in the continuous casting device 201 and the continuous casting method according to the present embodiment, the number and the total capacity of the hearths 13 for titanium to be used at continuous casting for the slab 32*a* made of titanium are smaller than those of the hearths 23 for titanium alloy. In addition, the number of the plasma torches 5 and also the total output, per unit melting amount, of the plasma torches 5 are made smaller than those to be used at the time of continuous casting for the ingot 32*b* made of a titanium alloy. This makes it possible to preferably heat the surface of the molten metal 31 in the hearths 3 while reducing the electric power consumption rate. On the other hand, the number and the total capacity of the hearths 23 for titanium alloy to be used at the time of continuous casting for the ingot 32*b* made of a titanium alloy are made greater than those of the hearths 13 for titanium. In addition, the number of the plasma torches 5 and also the total output, per unit melting amount, of the plasma torches 5 are made greater than those at the time of continuous casting for the slab 32*a* made of titanium. This makes it possible to preferably heat the surface of the molten metal 31 in the hearths 3 while suppressing the molten metal 31 from being solidified in the hearths 3.

[Third Embodiment]

(Constitution of Continuous Casting Device)

Figure 5:
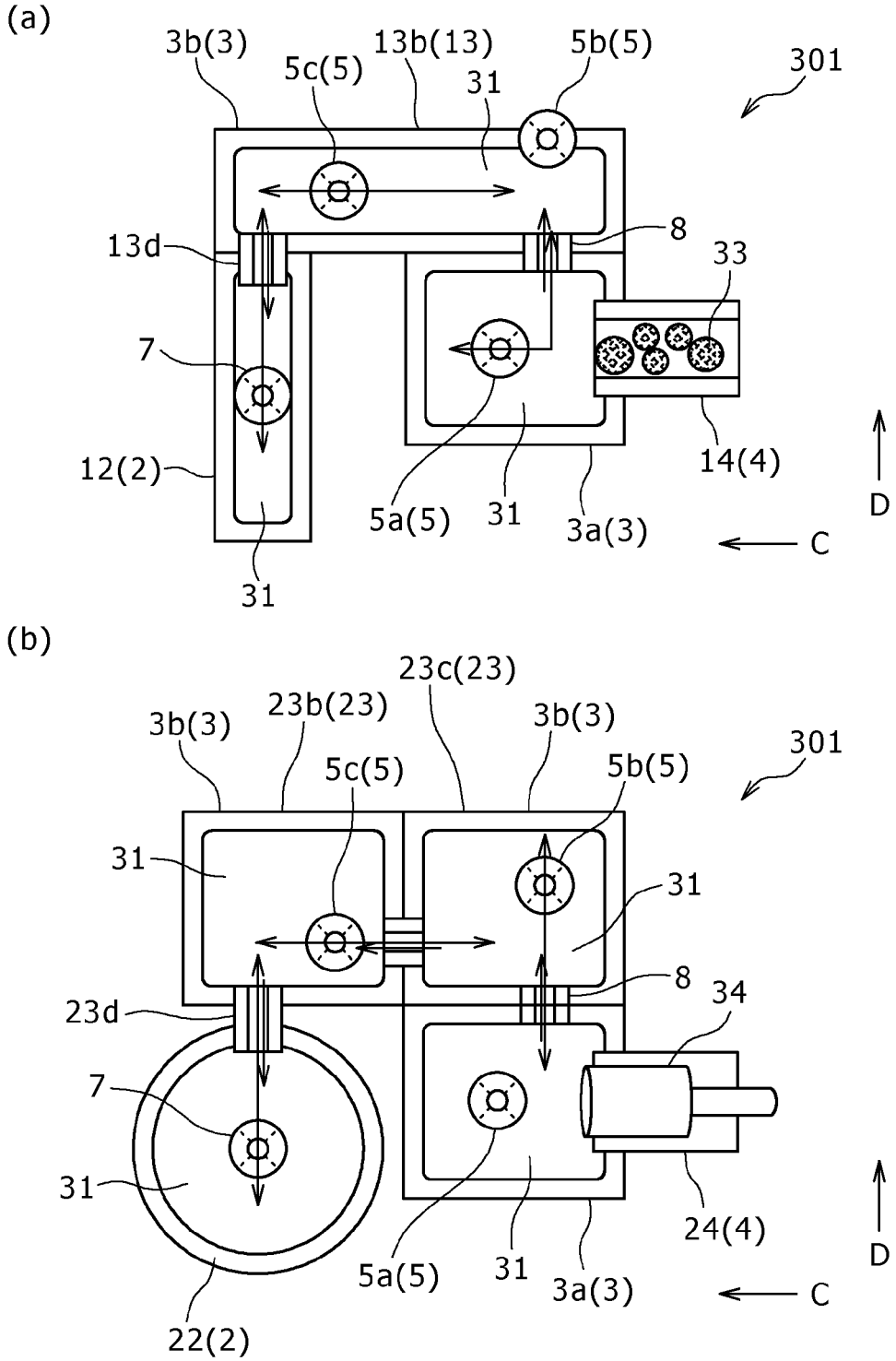
[FIG. 5] FIG. 5(*a*) is a top view showing production of titanium ingots by continuous casting using a continuous casting device according to Third Embodiment and FIG. 5(*b*) is a top view showing production of titanium alloy ingots by continuous casting using the continuous casting device according to Third Embodiment.

A continuous casting device 301 according to Third Embodiment of the present invention will next be described. Constituent elements similar to those described above are identified by the same reference number and a description on them is omitted. A difference between the continuous casting device 301 of the present embodiment and the continuous casting device 1 of First Embodiment is that as shown in FIGS. 5(*a*) and (*b*), the raw material introduction hearth 3*a* and the mold 2 are arranged in line in a direction C (predetermined direction) and at the same time, the raw material introduction hearth 3*a* and the mold 2 are arranged in line with the molten metal transfer hearth 3*b* in a direction D, which is a direction orthogonal to the direction C. The direction D is not limited to an orthogonal direction to the direction C but it at least crosses the direction C.

At the time of continuous casting for the slab 32*a* made of titanium, as shown in FIG. 5(*a*), the molten metal injection hearth 13*b* is, as the hearth 13 for titanium exchangeable with the hearth 23 for titanium alloy, arranged in line with the raw material introduction hearth 3*a* and the mold 12 in the direction D. On the other hand, at the time of continuous casting for the ingot 32*b* made of a titanium alloy, as shown in FIG. 5(*b*), the molten metal injection hearth 23*b* and the flow control hearth 23*c* are, as the hearths 23 for titanium alloy exchangeable with the hearth 13 for titanium, arranged in line with the raw material introduction hearth 3*a* and the mold 22 in the direction D. This means that the raw material introduction hearth 3*a* is used both at the time of continuous casting for the slab 32*a* made of titanium and at the time of continuous casting for the ingot 32*b* made of a titanium alloy, without being exchanged. The position of the raw material introduction hearth 3*a* is fixed in the chamber. Thus, in the present embodiment, some of the plurality of hearths 3 are constituted to be exchangeable in accordance with the raw material of the ingot 32.

The hearths 23 for titanium alloy have the molten metal injection hearth 23*b* and the flow control hearth 23*c* and the hearth 13 for titanium has the molten metal injection hearth 13*b*, so that the number of the hearths 3 is greater in the former than in the latter. In addition, the hearths 23 for titanium alloy have a total capacity greater than that of the hearth 13 for titanium.

The plurality of hearths 3 have thereabove three plasma torches 5. These plasma torches 5 penetrate through a chamber. They are swingable with the support 5*d* (refer to FIG. 3) as a center and at the same time, they are also movable vertically. Since the plasma torches 5 are swingable with the support 5*d* as a center, they can each be moved linearly or in an L-shape as shown by the arrow in FIGS. 5(*a*) and (*b*). The plasma torches 7 provided above the mold 2 can be moved in a similar manner.

At continuous casting for the slab 32*a* made of titanium, as shown by the arrow in FIG. 5(*a*), the plasma torch 5*a* provided above the raw material introduction hearth 3*a* is operated in an L-shape so as to travel above the channel 8. The plasma torch 5*c* provided above the molten metal injection hearth 13*b* is operated linearly along the long-side direction of the molten metal injection hearth 13*b*. The plasma torch 7 provided above the mold 12 is operated linearly along the long-side direction of the mold 12 so as to travel above the molten metal injection unit 13*d*. At this time, the plasma torch 5*b* is in a suspended state. Being operated as described above, the plasma torch 5*a* heats the raw material and the surface of the molten metal 31 in the raw material introduction hearth 3*a*, and the surface of the molten metal 31 in the channel 8; the plasma torch 5*c* heats the surface of the molten metal 31 in the molten metal injection hearth 13*b*; and the plasma torch 7 heats the surface of the molten metal 31 in the mold 12 and the surface of the molten metal 31 in the molten metal injection unit 13*d*.

At the time of continuous casting for the ingot 32*b* made of a titanium alloy, on the other hand, as shown by the arrow in FIG. 5(*b*), the plasma torch 5*a* provided above the raw material introduction hearth 3*a* is operated in almost a stationary state above the raw material introduction hearth 3*a*. The plasma torch 5*b* provided above the flow control hearth 23*c* is operated linearly so as to travel above the channel 8 which links the raw material introduction hearth 3*a* and the flow control hearth 23*c* to each other. The plasma torch 5*c* provided above the molten metal injection hearth 23*b* is operated linearly so as to travel above the channel 8 which links the flow control hearth 23*c* and the molten metal injection hearth 23*b* to each other. The plasma torch 7 provided above the mold 22 is operated linearly so as to travel above the molten metal injection unit 23*d*. Being operated as described above, the plasma torch 5*a* heats the ingot 34 to be advanced by the raw material introduction unit 24 and the surface of the molten metal 31 in the raw material introduction hearth 23*a*; the plasma torch 5*b* heats the surface of the molten metal 31 in the flow control hearth 23*c* and the surface of the molten metal 31 in the channel 8 which links the raw material introduction hearth 3*a* and the flow control hearth 23*c* to each other; the plasma torch 5*c* heats the surface of the molten metal 31 in the molten metal injection hearth 23*b* and the surface of the molten metal 31 in the channel 8 which links the flow control hearth 23*c* and the molten metal injection hearth 23*b* to each other; and the plasma torch 7 heats the molten metal 31 in the mold 22 and the surface of the molten metal 31 in the molten metal injection unit 23*d*.

Thus, the number of the plasma torches 5 to be used at the time of continuous casting for the ingot 32*b* made of a titanium alloy is greater than the number of the plasma torches 5 to be used at the time of continuous casting for the slab 32*a* made of titanium. In addition, the total output, per unit melting amount, of the plasma torches 5 to be used at the time of continuous casting for the ingot 32*b* made of a titanium alloy is greater than the total output, per unit melting amount, of the plasma torches 5 to be used at the time of continuous casting for the slab 32*a* made of titanium.

When the mold 2, the molten metal transfer hearth 3*b*, and the raw material introduction hearth 3*a* are arranged linearly in order of mention (refer to FIGS. 1(*a*) and (*b*) and FIGS. 2 (*a*) and (*b*)) or when they are arranged in an L-shape, the position of the raw material introduction hearth 3*a* varies with the number or size of the molten metal transfer hearth 3*b* and also the position of introducing a raw material into the raw material introduction hearth 3*a* varies accordingly. When the raw material introduction hearth 3*a* and the mold 2 are arranged in line in the direction C and at the same time, the raw material introduction hearth 3*a* and the mold 2 are arranged in line with the molten metal transfer hearth 3*b* in the direction D orthogonal to the direction C, the position of the raw material introduction hearth 3*a* can be fixed without being influenced by the number of size of the molten metal transfer hearth 3*b*. By fixing the position of the raw material introduction hearth 3*a*, the position of introducing a raw material into the raw material introduction hearth 3*a* can be fixed. When switching is performed between continuous casting for the slab 32*a* made of titanium and continuous casting for the ingot 32*b* made of a titanium alloy, changing the position of introducing a raw material is not necessary and the raw material introduction unit 4 which introduces a raw material into the raw material introduction hearth 3*a* can be placed at a fixed position. This enhances the work efficiency. The placing position of the raw material introduction unit 14 shown in FIG. 5(*a*) is the same as the placing position of the raw material introduction unit 24 shown in FIG. 5(*b*). An excessive increase in the length of the chamber in the direction C is not required so that a chamber can be downsized and thereby a heat loss from the chamber can be reduced. Since the raw material introduction unit 14 and the raw material introduction unit 24 are placed at the same position, the introduction of the raw material can be monitored from outside the chamber without changing a monitoring direction. This facilitates the monitoring of the working condition.

In addition, since the surface of the molten metal 31 in the channel 8 is also heated with the plasma torch 5, solidification of the molten metal 31 in the channel 8 can be suppressed. Further, since the surface of the molten metal 31 in the molten metal injection unit 23*d* is also heated with the plasma torch 7, solidification of the molten metal 31 in the molten metal injection unit 23*d* can be suppressed.

A shield plate (not illustrated) is preferably provided between the mold 2 and the raw material introduction hearth 3*a* in order to prevent a splash generated during introduction of the raw material into the raw material introduction hearth 3*a* from entering the mold 2.

(Modification Example)

Figure 6:
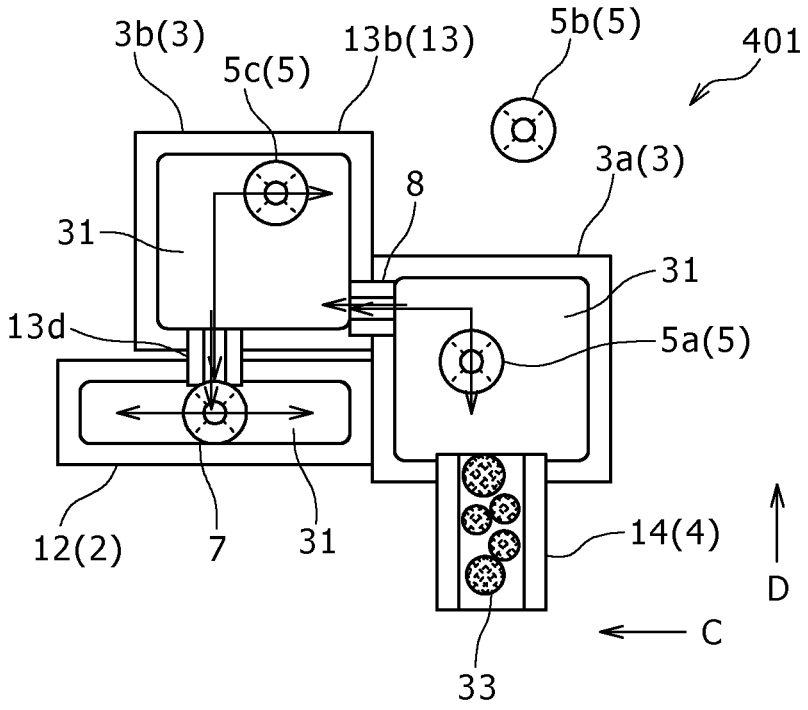
[FIG. 6]

At the time of continuous casting for the slab 32*a* made of titanium, a continuous casting device 401 shown in FIG. 6 may be used. A difference of this continuous casting device 401 from the continuous casting device 301 shown in FIG. 5(*a*) is that the mold 12 and the molten metal transfer hearth 3*b* (molten metal injection hearth 13*b*) are arranged in line in the direction D and at the same time, the raw material introduction hearth 3*a* and the molten metal transfer hearth 3*b* are not arranged in line in the direction D. This means that the molten metal transfer hearth 3*b* is arranged in line only with the mold 12 in the direction D. The molten metal injection hearth 13*b* which is the molten metal transfer hearth 3*b* is the hearth 13 for titanium. It can be exchanged with the hearth 23 for titanium alloy. The raw material introduction hearth 3*a* is used both at the time of continuous casting for the slab 32*a* made of titanium and at the time of continuous casting for the ingot 32*b* made of a titanium alloy without being exchanged.

As shown by the arrow, the plasma torch 5*a* placed above the raw material introduction hearth 3*a* is operated in an L-shape so as to travel above the channel 8 and at the same time, the plasma torch 5*c* placed above the molten metal injection hearth 13*b* is operated in an L-shape so as to travel above the molten metal injection unit 13*d*. The plasma torch 7 placed above the mold 12 is operated linearly along the long-side direction of the mold 12. At this time, the plasma torch 5*b* is in a suspended state. Being operated as described above, the plasma torch 5*a* heats the raw material and the surface of the molten metal 31 in the raw material introduction hearth 3*a* and the surface of the molten metal 31 in the channel 8; the plasma torch 5*c* heats the surface of the molten metal 31 in the molten metal injection hearth 13*b* and the surface of the molten metal 31 in the molten metal injection unit 13*d*; and the plasma torch 7 heats the surface of the molten metal 31 in the mold 12.

The continuous casting device 401 is constituted so that the molten metal 31 is injected from the molten metal injection unit 13*d* to the center portion in the long-side direction of the mold 12 having a rectangular cross-sectional shape. Further, the raw material introduction unit 14 introduces sponge titanium 33 into the raw material introduction hearth 3*a* in a direction different by 90 degrees from that of the continuous casting device 301 shown in FIG. 5(*a*).

(Advantages)

As described above, in the continuous casting devices 301 and 401 according to the present embodiment, the raw material introduction hearth 3*a* and the mold 2 are arranged in line in the direction C, while at least one of the raw material introduction hearth 3*a* and the mold 2 and the molten metal transfer hearth 3*b* are arranged in line in the direction D which crosses the direction C. This makes it possible to fix the position of the raw material introduction hearth 3*a* without being influenced by the number or size of the molten metal transfer hearth 3*b*. When the mold 2, the molten metal transfer hearth 3*b*, and the raw material introduction hearth 3*a* are arranged linearly or in an L-shape in order of mention, the position of the raw material introduction hearth 3*a* varies with the number or size of the molten metal transfer hearth 3*b* and the position of introducing the raw material into the raw material introduction hearth 3*a* also varies. By arranging the raw material introduction hearth 3*a* and the mold 2 in line in the direction C and fixing the position of the raw material introduction hearth 3*a*, the position of introducing the raw material into the raw material introduction hearth 3*a* can be fixed. As a result, at the time of switching between continuous casting for the slab 32*a* made of titanium and continuous casting for the ingot 32*b* made of a titanium alloy, changing the raw material introduction position is not required, making it possible to enhance the work efficiency. In addition, without necessity to needlessly increase the C-direction length of the chamber for housing the continuous casting device 301 therein, the chamber can be downsized so that a heat loss from the chamber can be reduced.

In the continuous casting devices 301 and 401 and the continuous casting method according to the present embodiment, since the plasma torch 5 also heats the surface of the molten metal 31 in the channel 8, solidification of the molten metal 31 in the channel 8 can be suppressed.

The embodiments of the present invention have each been described above, but they are only specific examples and do not particularly limit the present invention. The design of the specific constitution or the like can be changed as needed. The effects and advantages described in the embodiments of the present invention are only the most preferable effects and advantages produced by the present invention. The effects and advantages of the present invention are not limited to those described in the embodiments of the present invention.

The present application is based on Japanese Patent Application (Japanese Patent Application No. 2012-049517) filed on Mar. 6, 2012 and contents of this application are incorporated herein by reference.

[LEGENDS]

1,201,301,401: Continuous casting device
2,12,22: Mold
3: Hearth
3*a*: Raw material introduction hearth
3*b*: Molten metal transfer hearth
4,14,24: Raw material introduction unit
5,5*a*,5*b*,5*c*: Plasma torch (plasma arc heater)
5*d*: Support
6: Withdrawal unit
6*a*,16*a*,26*a*: Starting block
7: Plasma torch
8: Channel
13: Hearth used for titanium
13*a*,23*a*: Raw material introduction hearth
13*b*,23*b*: Molten metal injection hearth
13*d*,23*d*: Molten metal injection unit
23: Hearth for titanium alloy
23*c*: Flow control hearth
31: Molten metal
32: Ingot
32*a*: Slab (titanium ingot)
32*b*: Ingot (titanium alloy ingot)
33: Sponge titanium
34: Ingot
13: Bolt

The invention claimed is:

1. A continuous casting device for titanium ingot and titanium alloy ingot comprising: a bottomless mold and a plurality of hearths that injects a molten metal having titanium or a titanium alloy melted therein into the bottomless mold via the plurality of hearths and while solidifying the molten metal, withdraws the resulting ingot downward, and thereby produces an ingot made of the titanium or titanium alloy by continuous casting, wherein as at least some of the hearths, hearths for titanium to be used at the time of continuous casting for titanium ingot and hearths for titanium alloy to be used at the time of continuous casting for titanium alloy ingot can be used exchangeably, the number of the hearths for titanium alloy is greater than the number of the hearths for titanium, and the total capacity of the hearths for titanium alloy is greater than the total capacity of the hearths for titanium.

2. The continuous casting device for titanium ingot and titanium alloy ingot according to claim 1, comprising a plurality of plasma arc heaters provided swingably above the hearths and capable of heating the surface of the molten metal in the hearths, wherein the number of the plasma arc heaters to be used at the time of continuous casting for titanium alloy ingot is greater than the number of the plasma arc heaters to be used at the time of continuous casting for titanium ingot, and the total output, per unit melting amount, of the plasma arc heaters to be used at the time of continuous casting for titanium alloy ingot is greater than the total output, per unit melting amount, of the plasma arc heaters to be used at the time of continuous casting for titanium ingot.

3. The continuous casting device for titanium ingot and titanium alloy ingot according to claim 2, wherein the hearths adjacent to each other are linked via a channel, and the plasma arc heaters heat also the surface of the molten metal in the channel.

4. The continuous casting device for titanium ingot and titanium alloy ingot according to claim 3, wherein the hearths include a raw material introduction hearth in which a raw material of the ingot is to be introduced and a molten metal transfer hearth placed on a downstream side of the raw material introduction hearth, the raw material introduction hearth and the mold are arranged in line in a predetermined direction, and at least one of the raw material introduction hearth and the mold and the molten metal transfer hearth are arranged in line in a direction crossing the predetermined direction.

5. The continuous casting device for titanium ingot and titanium alloy ingot according to claim 2, wherein the hearths include a raw material introduction hearth in which a raw material of the ingot is to be introduced and a molten metal transfer hearth placed on a downstream side of the raw material introduction hearth, the raw material introduction hearth and the mold are arranged in line in a predetermined direction, and at least one of the raw material introduction hearth and the mold and the molten metal transfer hearth are arranged in line in a direction crossing the predetermined direction.

6. The continuous casting device for titanium ingot and titanium alloy ingot according to claim 1, wherein the hearths include a raw material introduction hearth in which a raw material of the ingot is to be introduced and a molten metal transfer hearth placed on a downstream side of the raw material introduction hearth, the raw material introduction hearth and the mold are arranged in line in a predetermined direction, and at least one of the raw material introduction hearth and the mold and the molten metal transfer hearth are arranged in line in a direction crossing the predetermined direction.

7. The continuous casting device for titanium ingot and titanium alloy ingot according to claim 1, further comprising a withdrawal unit which withdraws the ingot toward below the mold, wherein the mold is exchangeable with another mold so that they have the same gravity center position, and the withdrawal unit withdraws the ingot with the gravity center position as a center.

8. A continuous casting method for titanium ingot and titanium alloy ingot comprising: injecting a molten metal having titanium or a titanium alloy melted therein into a bottomless mold via a plurality of hearths and while solidifying the molten metal, withdrawing the resulting ingot downward, and thereby producing an ingot made of the titanium or titanium alloy by continuous casting, wherein as at least some of the hearths, hearths for titanium to be used at the time of continuous casting for titanium ingot and hearths for titanium alloy to be used at the time of continuous casting for titanium alloy ingot can be used exchangeably, the number of the hearths for titanium alloy is greater than the number of the hearths for titanium, the total capacity of the hearths for titanium alloy is greater than the total capacity of the hearths for titanium, the hearths for titanium alloy are exchanged with the hearths for titanium at the time of continuous casting for titanium ingot, and the hearths for titanium are exchanged with the hearths for titanium alloy at the time of continuous casting for titanium alloy ingot.

9. The continuous casting method for titanium ingot and titanium alloy ingot according to claim 8, further comprising heating the surface of the molten metal in the hearths with a plurality of plasma arc heaters provided swingably above the hearths, wherein the number of the plasma arc heaters to be used at the time of continuous casting for titanium alloy ingot is greater than the number of the plasma arc heaters to be used at the time of continuous casting for titanium ingot, and the total output, per unit melting amount, of the plasma arc heaters to be used at the time of continuous casting for titanium alloy ingot is greater than the total output, per unit melting amount, of the plasma arc heaters to be used at the time of continuous casting for titanium ingot.

10. The continuous casting method for titanium ingot and titanium alloy ingot according to claim 9, further comprising heating, with the plasma arc heaters, also the surface of the molten metal in the channel which links hearths adjacent to each other.

11. The continuous casting method for titanium ingot and titanium alloy ingot according to claim 10, wherein the mold can be exchanged with another mold so that they have the same gravity center position, and the ingot is withdrawn downward below the mold with the gravity center position as a center.

12. The continuous casting method for titanium ingot and titanium alloy ingot according to claim 9, wherein the mold can be exchanged with another mold so that they have the same gravity center position, and the ingot is withdrawn downward below the mold with the gravity center position as a center.

13. The continuous casting method for titanium ingot and titanium alloy ingot according to claim 8, wherein the mold can be exchanged with another mold so that they have the same gravity center position, and the ingot is withdrawn downward below the mold with the gravity center position as a center.

* * * * *